United States Patent [19]

Manning et al.

[11] 4,072,225

[45] Feb. 7, 1978

[54] COMBINED PIN FEED AND PRESSURE ROLL FORMS ADVANCEMENT APPARATUS

[75] Inventors: Donald Franklin Manning, Endicott; Robert Allan Ryan, Endwell, both of N.Y.

[73] Assignee: International Business Machines Corporation, Armonk, N.Y.

[21] Appl. No.: 744,356

[22] Filed: Nov. 23, 1976

[51] Int. Cl.[2] ..... B41J 15/00

[52] U.S. Cl. ..... 197/133 R

[58] Field of Search ..... 197/133 R

[56] References Cited

U.S. PATENT DOCUMENTS

| | | | |
|---|---|---|---|
| 2,664,988 | 1/1954 | Metzner | 197/133 R |
| 3,285,164 | 11/1966 | Malavazos | 197/133 R X |
| 3,308,919 | 3/1967 | Cunningham | 197/133 R X |
| 3,323,700 | 6/1967 | Epstein et al. | 197/133 R UX |
| 3,421,612 | 1/1969 | Pitt | 197/133 R |

*Primary Examiner*—Ernest T. Wright, Jr.
*Attorney, Agent, or Firm*—Andrea P. Bryant

[57] ABSTRACT

A high speed printer wherein sheets of continuous forms are fed to the print station by a pin feed sprocket type mechanism drivingly engaging marginally punched holes in the sheets. Each sheet is accurately moved past the print station during print time under control of a pressure feed roll mechanism the operating characteristics of which are independent of the relative position or physical condition of the marginal holes engaged by the sprocket. This sprocket and pressure feed roll coaction results in precision alignment as among printing lines within a sheet being advanced through a high speed printer.

7 Claims, 3 Drawing Figures

COMBINED PIN FEED AND PRESSURE ROLL FORMS ADVANCEMENT APPARATUS

BACKGROUND OF THE INVENTION

1. Field of the Invention

This invention relates to handling indeterminate length sheet material for high speed advancement in a step-by-step manner along the length dimension. More particularly, this invention pertains to accurately positioning sheets of marginally punched continuous forms during printing in a high speed printer.

2. Description of the Prior Art

Traditionally, output printers in data processing systems have used marginally punched fan folded continuous forms fed by so-called tractors or sprocket or pin feed mechanisms. Marginally punched continuous forms may suffer such defects as (1) variations from sheet to sheet, or more importantly within a sheet, relative to corresponding hole positions; (2) variations in sheet dimensions caused by such environmental conditions as humidity; or even (3) partial destruction or separation of the marginally perforated portion from the main body of the sheets. Occasionally, manufacturing errors result in misalignment between feeding pins and holes in marginally punched forms, thereby damaging the forms.

Such defects and manufacturing errors are not generally significant enough to halt printer operation, but they do affect the spacing between printed lines, and thereby the appearance of the printed sheet. For this reason, continuous forms printing applications have been limited to those in which precision alignment of print lines within a sheet was not critical.

Pressure rollers have been used to tension and/or withdraw marginally punched continuous forms in a printer, but the forms are usually advanced past the print station by tractor pin feed mechanisms, thereby making accuracy of print alignment dependent on the location and condition of the marginal perforations.

With the development of nonimpact printing techniques, greater precision in character/symbol size and placement is possible. An array of ink jets, for example, may be accurately controlled to produce fine line or character segments for making graphs, diagrams and the like, where precision requirements are of the order of 0.002 inches (0.05 mm).

Heretofore, however, such accuracy in advancing marginally punched continuous forms has not been obtainable using traditional apparatus and methods. Thus marginally punched forms have not been used with much success in applications where the acceptability of the output is a function of fine print alignment. Such accuracy is approached in systems where paper is incrementally advanced under control of a pressure drive roll. However, with continuous forms, there is a danger of propagating alignment errors from sheet-to-sheet during a run.

OBJECTS OF THE INVENTION

It is an object of our invention to provide an improved feeding mechanism for marginally punched continuous forms in a high speed printer.

It is another object of our invention to obtain precision alignment among print lines within a sheet of marginally punched continuous forms in a high speed printer.

A further object of our invention is to substantially eliminate the effect of deformation or destruction of marginal perforations on print alignment in high speed printers.

SUMMARY OF THE INVENTION

The stated objects are accomplished by positioning sheets of continuous forms at the print station under control of a pin feed sprocket drive cooperating with marginal perforations in the forms. During printing, however, each sheet is incrementally advanced by a pressure roll drive, the operation and accuracy of which are independent of the marginal perforations. The pin feed and drive roll are driven in synchronism by a stepper motor.

When the desired number of lines have been printed on a sheet, the pressure roll drive is disengaged so that form movement is again under control of the pin feed mechanism in order to advance the next sheet into position for printing. Before printing occurs, each sheet is registered by means of the pin feed sprocket drive while the pressure roll drive is disengaged. In this manner, propagation of alignment errors from sheet to sheet is avoided. The pressure roll drive is then activated, and each sheet is under accurate control of the pressure roll drive during printing. However, the pin feed mechanism continues to engage the marginal perforations of the continuous form as each sheet is advanced past the print station during print time by the pressure roll drive mechanism.

The foregoing and other objects, features and advantages of our invention will be apparent from the following more particular description of the preferred embodiment as illustrated in the accompanying drawing.

DETAILED DESCRIPTION OF A PREFERRED EMBODIMENT

Figure 1:
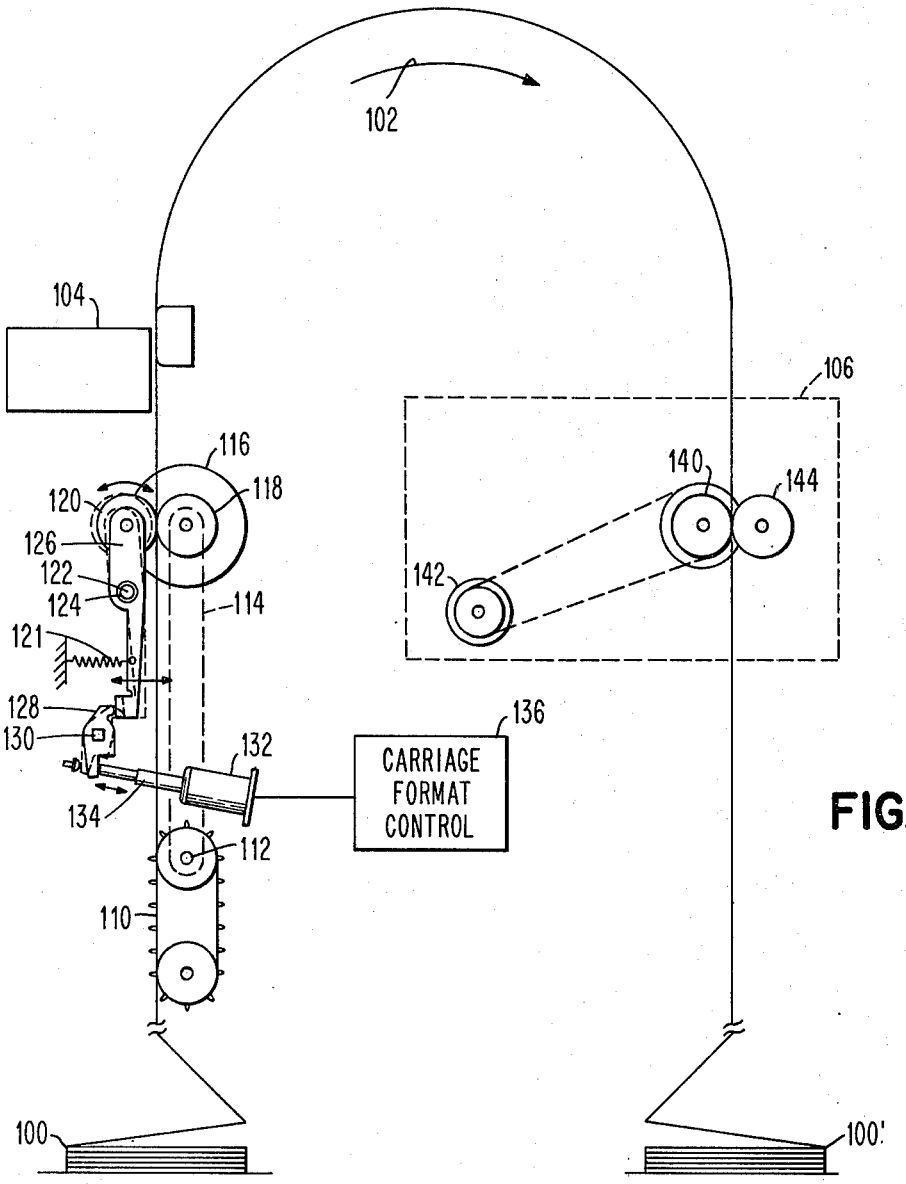
FIG. 1 is a schematic side view of a high speed printer with apparatus embodying our invention.

A high speed printer of the type schematically shown in FIG. 1 in general comprises means for feeding a supply of continuous forms 100 in the direction indicated by arrow 102 past a print station 104 and extractor means 106 for withdrawing printed forms 100'.

Our apparatus provides for a two phase advancement of sheets of continuous forms. During the first or feeding phase, a conventional sprocket drive assembly engaging the marginal perforations advances a sheet of continuous forms to the print station. In the second or print phase, a pressure roll drive assembly located between the sprocket drive means and the print station is activated for controlling line by line sheet advancement past the print station.

For advancing the forms 100 during the feed phase, we provide a set of tractors 110, only one of which is shown, which are adjustable and settable along their common drive shaft 112 to accommodate various widths of marginally punched forms. Shaft 112 is driven through belt 114 by stepper motor 116.

Motor 116 incrementally rotates drive roller 118, which may be steel, in synchronism with shaft 112. A set of retractable, resilient pressure drive rollers 120, of which one is shown, is provided to cooperate with drive roller 118 for advancing forms 100 during a print phase. Each of rollers 120 is biased toward drive roller 118 by a spring 121. Pressure rollers 120 are mounted on rod 124, the center 122 of which is the point about which rollers 120 pivot into and out of position for cooperation with drive roller 118. Each pressure roller 120 is mounted by an arm 126 on rod 124 which extends the width of the printer. One end of arm 126 contacts bell crank 128 which is pivotable about point 130. Solenoid 132, the plunger 134 of which is in contact with the other extension of bell crank 128, is provided for moving pressure rollers 120 into and out of engagement with drive roller 118.

Solenoid 132 is operable in response to electrical signals which are generated by control means 136 known in the high speed printer art, such as disclosed in U.S. Pat. No. 3,576,164 to Drejza et al.

A conventional pull-down roller assembly is indicated generally at 106 wherein rollers 140, of which only one is shown, are continuously driven by motor 142. Pull-down pressure rollers 144 are biased by conventional means, not shown, into contact with the pull-down drive rollers 140 to engage and withdraw forms 100'. The unit provides a constant tension on the forms 100' by means of an internal friction drive in rollers 140.

OPERATION OF THE INVENTION

A length of paper is positioned in the printer such that the leading sheet is in a position for engagement by the pull-down roller assembly 106. Referring to FIG. 1, during feeding to the print station 104, rollers 120 are in their retracted position shown in phantom, and forms 100 move freely in direction 102 due to the motion imparted to the tractors 110 by stepper motor 116, and the pull-down roller assembly 106. The start, stop and running speed of stepper motor 116 is controlled in the conventional way.

Likewise, those skilled in the art will understand the generation of appropriate format control signals to control solenoid 132. In response to a signal indicating the initiation of printing on a given sheet, solenoid 132 is deenergized, causing plunger 134 to retract from the lower portion of bell crank 128 which pivots about point 130 thereby allowing the upper portion of bell crank 128 to move from arm 126. The spring 121 causes arm 126 to move from the position shown in phantom. Arm 126 pivots about point 122 and a sheet of forms 100 is drivingly engaged between rollers 120 and drive roller 118. The sheet of continuous forms 100 is then advanced incrementally by drive roller 118 in cooperation with pressure rollers 120. Paper is advanced past the print station 104 in a line by line manner completely under control of the pressure roller drive roller assembly 120, 118 respectively. It is to be noted that the accuracy of print alignment is dependent only on the accuracy of motion of stepper motor 116 and the accuracy of the diameter of drive roller 118.

When the printing operation on a particular sheet is completed solenoid 132 is energized, and bell crank 128 pivots forcing arm 126 to pivot about point 122 causing rollers 120 to be retracted from drive roller 118. Forms 100 are then again advanced by the combined movement of tractors 110 and the pulldown roller assembly 106.

Figure 2:
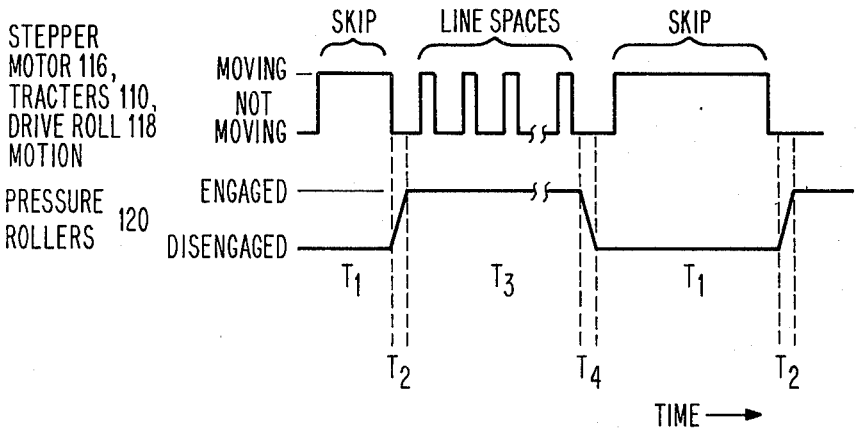
FIG. 2 is a timing diagram for the operation of our invention.

FIG. 2 is a timing diagram for the operation of a high speed printer having our improved apparatus for forms advancement. Time $T_1$ represents a feed operation during which tractors 110 are driven by stepper motor 116 and the pull-down rollers 140 are continuously driven by motor 142. The pull-down pressure rollers 144 rotate with the pull-down rollers 140. Stepper motor 116 rotates drive roller 118 but pressure rollers 120 are in their retracted position. A given sheet of continuous forms 100 is registered at the print station 104 prior to printing. This gross alignment is dependent on the accuracy of registration of the pin feed sprockets of tractors 110 and the mariginal perforations in the forms 100.

During time $T_2$, solenoid 132 is deenergized and rollers 120 are moved into position for cooperation with drive roller 118 to engage the sheet during printing for line by line advancement.

Time $T_3$ is print operation. During this interval, a sheet of continuous forms 100 is drivingly engaged between drive roller 118 and pressure rollers 120. Although tractors 110 continuously engage marginal perforations of forms 100 during print time, the pressure roll drive controls form advancement. Fine alignment is achieved because the engaging force of pressure rollers 120 and drive roller 118 is sufficiently great that sheet movement is strictly a function of the accuracy of stepper motor 116 and drive roll 118.

Time $T_4$ represents the interval during which solenoid 132 in energized and rollers 120 are moved out of the position in which they cooperate with drive roller 118.

A full cycle is composed of times $T_1$, $T_2$, $T_3$ and $T_4$ which occur in that sequence. Interval $T_1$, feeding and gross alignment of each sheet, and interval $T_3$, printing, are of varying duration depending on the number of lines printed and the spacing therebetween on a given sheet. The durations of intervals $T_2$ and $T_4$ are of course relatively constant.

In the operation of a printer equipped with apparatus embodying our invention, there may be a slight differential between the peripheral speeds of tractors 110 and drive roller 118, though both are driven by stepper motor 116, due to the physical characteristics of the components. Three situations could arise during time $T_3$: (a) where tractors 110 and drive roller 118 have the same peripheral speed, in which case there are no undesirable results; (b) the peripheral speed of driver roller 118 exceeds that of the tractors 110, in which case some damage to the marginal perforations may occur; and (c) the peripheral speed of tractors 110 may exceed that of drive roller 118 in which case, a slight blouse will form in the sheet between the tractors 110 and drive roller 118. When the desired number of lines have been printed and pressure rollers 120 are lifted, continuous forms 100 are again under the control of the tractors 110 and the pull-down roller assembly 106. Accordingly, any blouse that may have arisen will disappear as continuous form motion is re-registered with the tractor pin feed drive.

Figure 3:
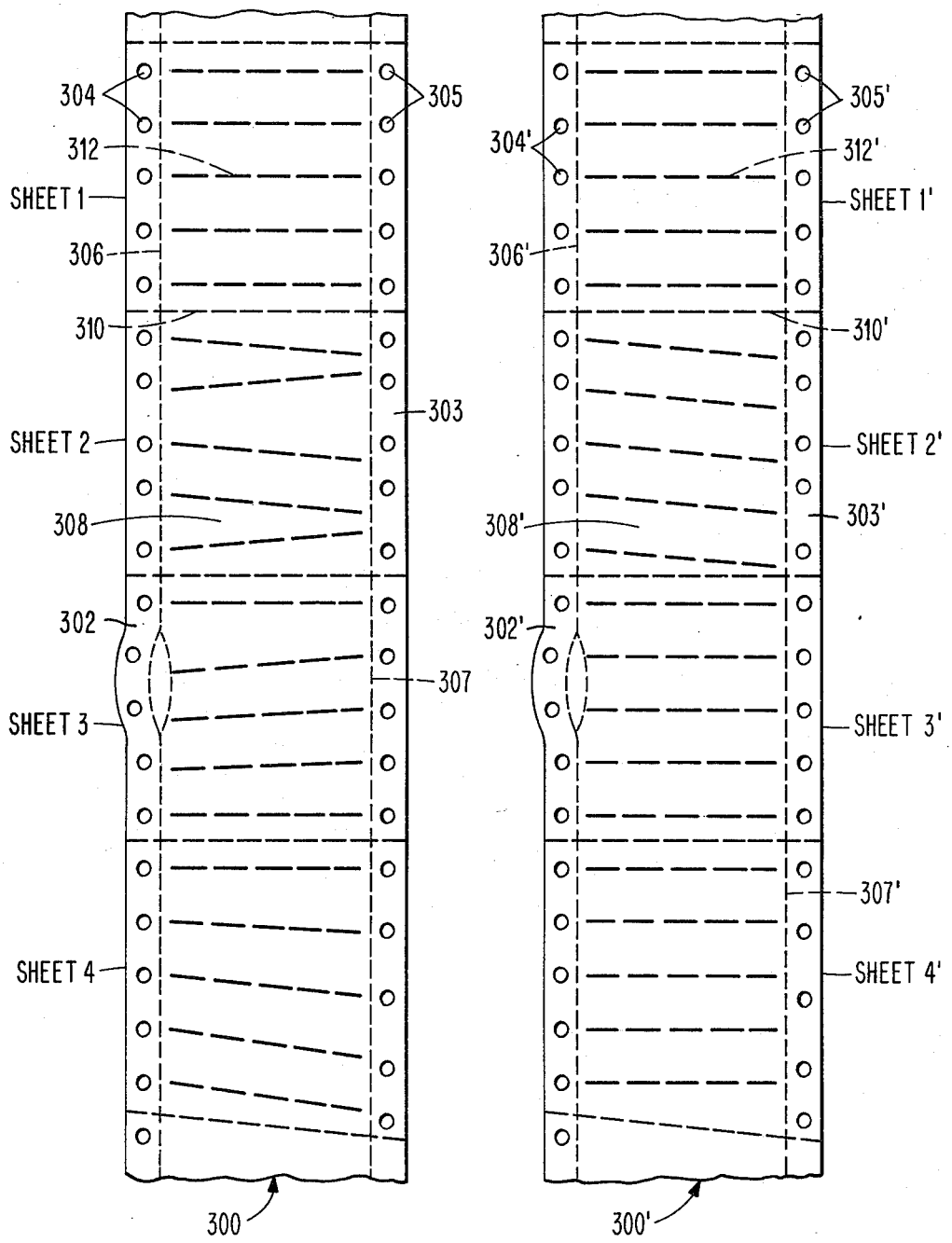
FIG. 3 is a diagramatic illustration comparing print alignment errors due to sheet condition likely to occur in high speed printers with and without the apparatus of our invention.

The advantages of our invention can be appreciated with reference to FIG. 3 which compares the influence on print alignment of certain sheet defects. Output from a printer including our combined pin feed and pressure roll forms advancement apparatus is compared to output from a typical prior art printer using only a pin feed drive. For purpose of illustration, various sheet irregularities are shown in a greatly exaggerated scale. Lengths of marginally punched continuous forms 300 and 300' are shown each identical except for print line alignment. As between the form lengths, reference numerals are the same for like portions with the segment showing the advantages of our invention having like numerals primed.

A multi-sheet segment of continuous forms is indicated generally at 300. Marginal strips 302 on the left and 303 on the right having spaced holes 304 and 305 respectively, may be separated along perforations 306 and 307 from the main print area 308. In FIG. 3, segment 300 is shown to have four sheets as defined by tear lines 310. Sheets 1 and 1' are in ideal condition, that is, there are no dimensional irregularities due, for example, to environmental conditions and all holes 304 and 305 are perfectly aligned. Thus, for sheet 1 using only a sprocket feed mechanism and sheet 1' using that mechanism in which our invention is embodied, print alignment as indicated by the lines 312 and 312' is as to be expected.

However, on sheets 2 and 2' marginal holes 304 and 305 are no longer evenly and oppositely spaced. The first or uppermost hole 304 is higher than the corresponding hole 305. A traditional pin feed mechanism advancing marginally punched forms 300 to and past the print station 104 results in the uneven line spacing shown on sheet 2. The paper is advanced from line-to-line by a feed mechanism dependent on hole location for accuracy. Sheet 2', printed by a printer having the apparatus of our invention, is different because only the topmost holes 304' and 305' influence print alignment, since they provide for gross alignment of each sheet at the print station 104. It will be recalled that as the forms are fed to the print station 104 by the pin feed mechanism of tractors 110, feeding under their control stops when the top of the sheet reaches the print station 104. Thereafter, line to line increments are made completely under control of the stepper motor 116 and pressure drive roll system comprising rollers 120 and 118. As can be seen in sheet 2' of form 300', the first line 312' appears as it would have without our improved apparatus, however, each succeeding line 312' is precisely aligned with the first line 312'.

In sheet 3, a portion of strip 302 has become separated from the main body 308. Since prior art systems control line to line incrementing in accordance with marginally punched holes 304, 305, any such misalignment in holes 304, 305 results in misalignment of print lines. In contrast, however, since in sheet 3' the top holes 304' and 305' are aligned, output from a printer equipped with our apparatus is not affected by the separation of a portion of strip 302' from the main body 308' and the lines 312' are parallel and spaced as desired. Sheet 4 illustrates dimensional changes in a sheet due for example to environmental factors. The bottom most sheet separation line 310 is not parallel to the last preceding separation line 310. The distance between holes 305 for instance increases without a corresponding increase in the distance between holes 304. Printed lines 312 are no longer parallel because line to line advancement of sheet 4 is carried out by pin feed means cooperating with holes 304 and 305. Accuracy of advancement is dependent on hole location. It can be seen that lines 312' are evenly spaced and parallel to each other because in high speed printers equipped with apparatus that embodies our invention, accuracy of line to line advancement is a function of stepper motor 116 movement imparted to drive roller 118 only.

In summary, then, it can be seen that irregularities in the spacing of holes 304 and 305, and irregularities in sheet dimensions due to environmental effects do not adversely influence the even and parallel alignment of lines printed in a device utilizing our apparatus for incremental advancement of sheets 1'–4' of segments 300' of 300' continuous forms past the print station 104. Since gross alignment of a given sheet at the print station 104 is a function of the uppermost holes 304' and 305' only, misalignment between those holes 304' and 305' produce an undesirable result as illustrated in sheet 2'. It is to be noted, referring again to sheets 2 and 2' in FIG. 3, that adverse effects on print alignment so caused is minor, if at all, and is not as extreme as in the printer not equipped with apparatus embodying our invention.

A further advantage resulting from our invention lies in the better accuracy obtainable between print lines 312' due to the smaller errors possible when sheets are advanced past the print station 104 under the complete control of a suitably chosen stepper motor 116. In other words error between lines 312' using our invention is less than the error achievable in devices depending entirely on the distance between the marginal perforations 304 and 305 for sheet advancement past the print station 104.

We have provided apparatus for use in a high speed printer to advance marginally punched continuous forms in an improved manner so that greater precision in print alignment results and the adverse effects of defects in marginal perforations on print line alignment within a sheet is substantially eliminated.

While our apparatus has been described with reference to a preferred embodiment wherein a tractor feed appears, it will be understood by those skilled in the art that other sprocket or pin feed mechanisms may be used. Likewise, while we have included a stepper motor in the description of our invention, it should be understood that some other incremental motion device may be substituted therefor. It is likely that other changes in form and detail will occur to those skilled in the art which may be made without departing from the spirit and scope of our invention.

What is claimed is:

1. In a high speed printer, including a print station, apparatus for advancing marginally punched continuous forms comprising in combination:

sprocket drive means for continuously engaging marginal perforations in the continuous forms and advancing sheets thereof to be printed;

pressure roll drive means, located along the direction of continuous forms advancement and intermediate said sprocket drive means and the print station, selectively actuable in response to format control signals, for incrementally advancing each sheet past the print station and independently of said sprocket drive means; and an incremental motion device for driving in synchronism said sprocket drive means and said pressure roll drive means; whereby each sheet is advanced continuously by said sprocket drive means whenever said pressure roll drive means is not actuated, and past said print station line by line during a printing operation whenever said pressure roll drive means is actuated.

2. A printer for eliminating error propagation from sheet to sheet in feeding marginally punched continuous forms and eliminating error within a sheet due to potential physical deformities, comprising:

a printing station;

a feeder drive means positioned ahead of said printing station for continuously feeding and positioning a sheet of the marginally punched continuous forms at said printing station by drivingly engaging marginal holes of the marginally punched continuous forms;

driver means positioned between said feeder drive means and said printing station for driving each sheet independently of said marginal holes and said feeder drive means through the printing station, to achieve precision spacing among print lines as well as total independence of print alignment from physical deformities in the sheet;

first pressure means positioned before said printing station and opposite to said driver means relative to said marginally punched continuous forms for pressing each sheet of said marginally punched continuous forms against said driver means to place said sheet under compression to avoid slippage of said sheet relative to said driver means;

extractor drive means positioned after said printing station to keep said marginally punched continuous forms under tension during feeding, and printing, as well as for extracting said marginally punched continuous forms from the printer; and second pressure means positioned after said printing station and opposite to said extractor drive means relative to said marginally punched continuous forms for pressing each sheet of said marginally punched continuous forms against said extractor drive means to place said sheet under compression to avoid slippage of said sheet relative to said extractor drive means.

3. The combination of claim 2, further comprising:

incrementing motor means connected to said feeder drive means and to said driver means to incrementally energize said feeder drive means and said driver means for providing incremental movement to said marginally punched continuous forms;

connecting means to connect said incrementing motor means with said feeder drive means and said driver means;

continuous motor means energizingly connected to said extractor drive means for providing moving forces to said extractor drive means;

moving means for urging and releasing said first pressure means against and from said sheet of said marginally punched continuous forms respectively during selected time intervals; and moving motor means for energizing said moving means during said intervals and thus generating moving forces in said moving means for loading and releasing said first pressure means at said intervals.

4. The combination of claim 3 wherein:

said driver means and said feeder drive means are incrementally energized by said incrementing motor means;

said first pressure means is loaded by said moving means against said sheet of said marginally punched continuous forms and through said sheet to said driver means at said intervals for pressing said sheet against said driver means and thus avoiding said slippage of said sheet during printing; and said first pressure means being in contact with said sheet of said marginally punched continuous forms during printing, for pressing said sheet against said driver means for avoiding said slippage and also for creating forces on said sheet against said driver means for generating that desired pressure condition for said precision spacing among print lines during printing.

5. The combination of claim 4 wherein:

said first pressure means being a free-wheeling means and made operative during printing by the forces transmitted to said first pressure means by said driver means through said sheet of said marginally punched continuous forms; and said second pressure means being a free-wheeling means and made operative during printing, feeding, positioning and extracting by the forces transmitted to said second pressure means by said extractor drive means through said sheet of said marginally punched continuous forms.

6. The combination of claim 5 wherein:

said first pressure means being released by said moving means from said sheet of said marginally punched continuous forms and from said driver means at said intervals before the start of feeding and positioning; and said first pressure means being out of contact with said sheet of said marginally punched continuous forms during feeding and positioning.

7. A method for accurately positioning marginally punched continuous forms for printing in a high speed printer to avoid propagating errors from sheet to sheet and eliminating errors within a sheet due to physical deformities, comprising the steps of:

grossly aligning sheets of the marginally punched continuous forms at a printing station prior to printing, utilizing the marginally punched holes of said sheets; and finely aligning each line within said sheets during printing at the printing station, independently of said marginally punched holes in said sheet of said marginally punched continuous forms.

* * * * *